US011311128B2

(12) United States Patent
Tanaskoski et al.

(10) Patent No.: US 11,311,128 B2
(45) Date of Patent: Apr. 26, 2022

(54) FLIP TRAY AND METHOD

(71) Applicants: Ivan Tanaskoski, Rochester, NY (US); Bratislav Glisic, Astoria, NY (US)

(72) Inventors: Ivan Tanaskoski, Rochester, NY (US); Bratislav Glisic, Astoria, NY (US)

( * ) Notice: Subject to any disclaimer, the term of this patent is extended or adjusted under 35 U.S.C. 154(b) by 232 days.

(21) Appl. No.: 16/783,680

(22) Filed: Feb. 6, 2020

(65) Prior Publication Data

US 2020/0245794 A1 Aug. 6, 2020

Related U.S. Application Data

(60) Provisional application No. 62/802,004, filed on Feb. 6, 2019.

(51) Int. Cl.
*A47G 23/06* (2006.01)
*A47G 23/02* (2006.01)

(52) U.S. Cl.
CPC ..... *A47G 23/06* (2013.01); *A47G 23/0208* (2013.01); *A47G 2023/0666* (2013.01)

(58) Field of Classification Search
CPC ..... A47G 23/06; A47G 23/0208; A47G 2023/0666; A47G 35/00; A47G 1/12; A47G 2400/08; A47F 7/00; A47F 7/02
See application file for complete search history.

(56) References Cited

U.S. PATENT DOCUMENTS 3,305,124 A 2/1967 Whiteford
4,527,707 A 7/1985 Heymann et al.
4,972,886 A * 11/1990 Bernstein ..... F25C 5/002 141/106
5,197,626 A 3/1993 Berstein
5,360,309 A 11/1994 Ishiguro
5,415,846 A * 5/1995 Berry, Jr. ..... A61L 2/26 220/366.1
6,071,056 A 6/2000 Hollowell
6,099,812 A * 8/2000 Allen ..... A61L 2/26 206/370
6,126,256 A 10/2000 Doces, II
6,896,149 B1 * 5/2005 Berry III ..... A61L 2/26 206/509
7,905,353 B2 * 3/2011 Baker ..... B65D 1/28 206/370
8,287,224 B2 10/2012 Carpinelli
8,899,904 B2 12/2014 Wang
8,950,595 B2 2/2015 Ammon
9,095,249 B2 8/2015 Domenech Grau
9,408,520 B2 8/2016 Vacca et al.
(Continued)

FOREIGN PATENT DOCUMENTS

WO 2013139017 9/2013

OTHER PUBLICATIONS

Buzz Catering, Amerbox Glass Rack Lid 50×50×3.5 cm; https://www.buzzcateringsupplies.com/amerbox-glass-rack-lid-50×50×3-5cm.html; printed Nov. 28, 2018; 2 pages.
(Continued)

*Primary Examiner* — Ko H Chan
(74) *Attorney, Agent, or Firm* — Bond Schoeneck & King, PLLC; Joseph M. Noto

(57) ABSTRACT

A method and device for transferring a plurality of glassware from a glassware-holding rack to a flip ray presenting an array of the glassware in an upright position.

7 Claims, 9 Drawing Sheets

(56) References Cited

U.S. PATENT DOCUMENTS

| | | | | |
|---|---|---|---|---|
| 9,896,259 | B2 * | 2/2018 | Soules | B65D 81/3813 |
| 10,961,010 | B2 * | 3/2021 | Clements | B65D 81/343 |
| 2009/0050587 | A1 * | 2/2009 | Sandor | A47L 15/501 211/74 |
| 2011/0253649 | A1 | 10/2011 | Clores | |
| 2011/0284555 | A1 * | 11/2011 | Barringer | A45C 11/20 220/592.01 |
| 2013/0233353 | A1 * | 9/2013 | Vacca | A47L 15/501 134/25.2 |
| 2014/0110362 | A1 | 4/2014 | Ammon | |
| 2018/0220823 | A1 | 8/2018 | Lawhon | |

OTHER PUBLICATIONS

Shuangjian—China Customized Plastic 25 Compartment Hotel Glass Rack Manufacturers and Factory; https://www.shuangjianb2b.com/plastic-rack/plastic-compartment-glass-rack/plastic-25-compartment-hotel-glass-rack.html; printed Nov. 28, 2018; 7 pages.

WebstaurantStore, Noble Products 25-Compartment Gray Full-Size Glass Rack with Blue Extender—19 3/8"×19 3/8"×5 3/4"; https://www.webstaurantstore.com/noble-products-25-compartment-gray-full-size-glass-rack-with-blue-extender-19-3-8-x-19-3-8-x-5-3-4/274RK251.html; printed Nov. 28, 2018; 10 pages.

International Search Report Form PCT/ISA/220, International Application No. PCT/US2020/016990 pp. 1-8, dated Apr. 22, 2020.

* cited by examiner

FLIP TRAY AND METHOD

CROSS REFERENCE

This application claims the benefit of the filing date of U.S. Provisional Patent Application Ser. No. 62/802,004, filed Feb. 6, 2019, which is hereby incorporated by reference in its entirety.

FIELD

The present disclosure relates to a flip tray and method for handling glassware useful to aid workers in the food/beverage industry.

BACKGROUND

Typically, aid workers in the food/beverage industry need to perform the time-consuming process of picking up clean glasses from glassware-holding racks and using them or placing them on a tray one at a time for later use. A typical glassware-containing rack requires the time-consuming task of reaching into numerous small chambers to retrieve the glassware individually. Further, it can be difficult to see broken or cracked glassware prior to reaching a hand into the rack to retrieve a glass. This can increase the chances of injury due being cut by broken glass. The art lacks an efficient, time-saving and safe method and device for handling glassware.

SUMMARY

In accordance with one aspect of the present disclosure, there is provided a flip tray including a rigid planar base having a top surface; a handle on opposite sides of the base; and a locking mechanism on opposite sides of the base, wherein the locking mechanism detachably secures the flip tray to a glassware-holding rack.

In accordance with another aspect of the present disclosure, there is provided a method for presenting an array of glassware in an upright position, including: placing a planar top surface of a flip tray face down on an open top of a glassware-holding rack containing a plurality of glassware facing down; detachably securing the flip tray to the glassware-holding rack; rotating the flip tray-secured glassware-holding rack upside down so the flip tray is on the bottom facing up and the glassware-holding rack is on the top facing down, allowing the glassware to move facing up onto the flip tray top surface; and detaching the glassware-holding rack from the flip tray exposing the plurality of glassware resting facing up on the top surface of the flip tray.

These and other aspects of the present disclosure will become apparent upon a review of the following detailed description and the claims appended thereto.

DETAILED DESCRIPTION

The present flip tray can be used to aid workers in the food/beverage industry and will save time when workers are picking up cleaned glasses upside down from a glassware-holding rack and placing the glasses facing up on any tray, for transport or later use. Using the flip tray product in accordance with the present process takes only a fraction of the time when compared with individually picking up glasses from glassware-holding racks and placing them on any tray manually. The flip tray can be a very useful product in the food and beverage industry. Besides saving time, it can be a safety product that can secure dean glassware on cruise ships.

The flip tray is a product that will help benefit the operations of any restaurant, bar, hotel catering event or cruise ship in which it may be implemented. The design and simplicity of the product allows for the safe and effective transport of clean glassware across any dining room, hallway, kitchen, dance floor or ballroom with ease. The subtle black design of the flip tray offers an elegant alternative for transporting glassware around the facility. Rather than lugging around a glassware-containing rack, the flip tray offers a less obtrusive lightweight alternative to the outdated look of glassware-containing racks. An anti-slip silicone mat or other suitable surface at the bottom of the flip tray ensures that the glasses remain in a safe and orderly fashion while being transported. If the person carrying the flip tray is jostled or needs to slightly tilt the tray when in transit the silicone grip will ensure that the glasses will not slide. Once the glasses arrive to their destination the person tasked with removing them from the flip tray can remove them faster and more efficiently than a traditional glassware-containing rack. The flip tray allows the user to pick up multiple glasses at once and use both hands to retrieve them making it a more efficient and less time-consuming task. The flip tray is also a safer product than the prior art. The design of the flip tray lets the user inspect the glassware before it arrives to its destination. This allows them to verify the cleanliness and sterility of the glassware while ensuring that there are no chips or breakage before transport. The flip tray also eliminates the necessity for someone to reach blindly into one of the chambers of a glassware-containing rack where broken glass could be hidden from sight. The flip tray is a product that could be integrated into any service establishment and have an instantaneous impact on the quality, efficiency and safety of service.

The disclosure will be further illustrated with reference to the following figures. It is understood that these examples are given by way of illustration and are not meant to limit the disclosure or the claims to follow.

Figure 1:
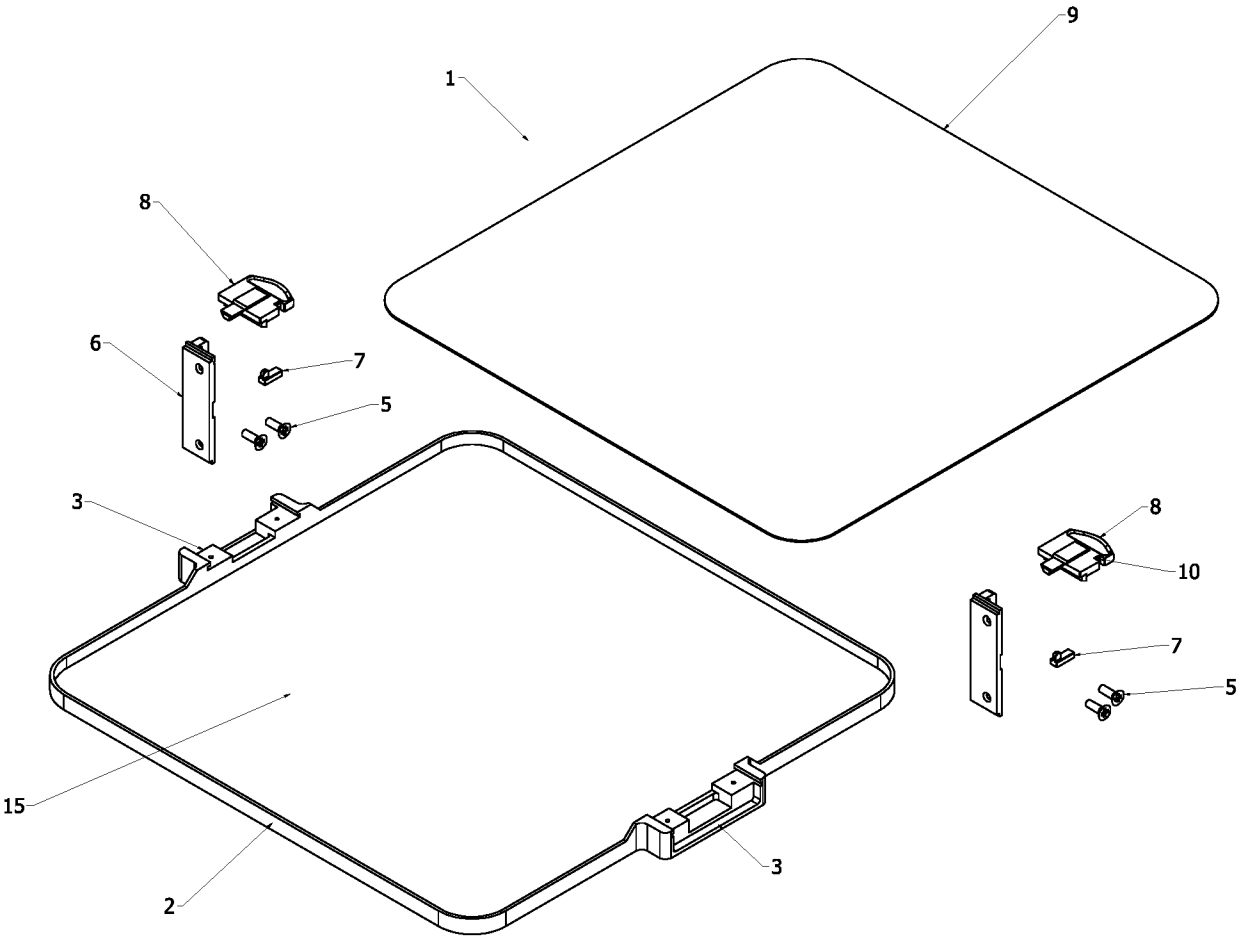
FIG. 1 shows an unassembled flip tray in accordance with an embodiment of the present disclosure.

In an embodiment, FIG. 1 shows various components of a flip tray in an unassembled state as described in more detail below. As shown in FIG. 1, the flip tray 1 has a planar base 2 having a top surface 15. Preferably, the base 2 is made from a material which is sufficiently sturdy to support a plurality of glassware. Suitable materials include strong, durable materials having high temperature resistant properties, such as polybutylene terephthalate (PBT), acrylonitrile butadiene styrene (ABS) or other plastic or other materials. In an embodiment, the planar base 2 can have an elastic or flexible top surface 15. As described in detail below, the top surface 15 of the base 2 can be optionally provided with a cover 9, which can be elastic or flexible, or the like, such as an anti-slip silicone mat. Preferably the flip tray is a black color. In an embodiment, the planar base 2 of the flip tray 1 has a shape which accommodates the plurality of glassware held within a glassware-holding rack. Glassware-holding racks are typically designed to hold a plurality of glassware which can be used to wash dirty glassware. Typical glassware-holding racks have four sides, a plurality of internal compartments for individual glasses, and a bottom all constructed of a lattice design and an open top which enables bulk washing of glassware placed face down in the rack, such as in a commercial kitchen or restaurant. Preferably, the shape of the flip tray base is similar to the shape of the open top of the glassware-holding rack, such as square or rectangle, but can take any complementary shape.

In an embodiment, the base has two handles 3 which can be positioned at any location on the base 2 that allows the user to hold or carry the base 2 loaded with glassware, preferably the handles 3 are positioned one on either side of the base 2. Optionally, the flip tray can have other numbers of handles and manners of handle placement. In an embodiment, the base has two locking mechanisms which can be positioned at any location on the base 2 that allows the flip tray to be detachably secured to the glassware-holding rack, preferably the locking mechanisms are positioned one on either side of the base 2. In an embodiment, each handle contains at least one locking mechanism which detachably secures the flip tray to a glassware-holding rack. In an embodiment, multiple locking mechanisms can be disposed in the handles or other locations on the base in addition to the handles. Other numbers and manners of locking features that can detachably secure the flip tray to the rack are suitable.

In an embodiment, the locking mechanism contains components such as a locking tab 7, locking key 8 and a bracket 6 which can be secured to the handle 3 by screws 5, as shown in FIG. 1. One bracket, key, and tab are shown however for each locking mechanism, any number, placement and manner of locking components is suitable. The bracket 6 can be made from PBT, ABS plastic or other rigid material. The color is preferably black. The bracket 6 functions to fit to the sides of the base 2 to hold the locking tab 7 and locking key 8 in place, which allows the locking tab and locking key to slide within the locking mechanism. The locking key 8 has a slot 10 and is a part that can be made from ABS plastic or other rigid material. The color is preferably black. The locking tab 7 can slide into the slot 10 of the locking key 8 which functions to secure the locking key when the locking key is in the locked position. One locking tab 7 is shown however, any number and manner of locking tabs are suitable. Other embodiments include a locking key which can be secured in the locked position without the need for a locking tab, not shown. The locking tab is preferably made from nickel or any other metal. In an embodiment, the locking tab can further attach to magnetic blocks in the locking key and magnetic blocks in the bracket as shown in more detail in FIGS. 7A and 7B. The locking tab holds the key in the locked position once the key has penetrated an opening in the glassware-holding rack. The two screws 5, for are shown for attaching the bracket, however any number and manner of attachment is suitable. The screws can be used to keep the locking system still and securely fastened to the base. Specifications include: ¼"-20 UNC-0.50" long-countersunk steel screw, however, other sizes and dimensions are suitable.

Figure 2:
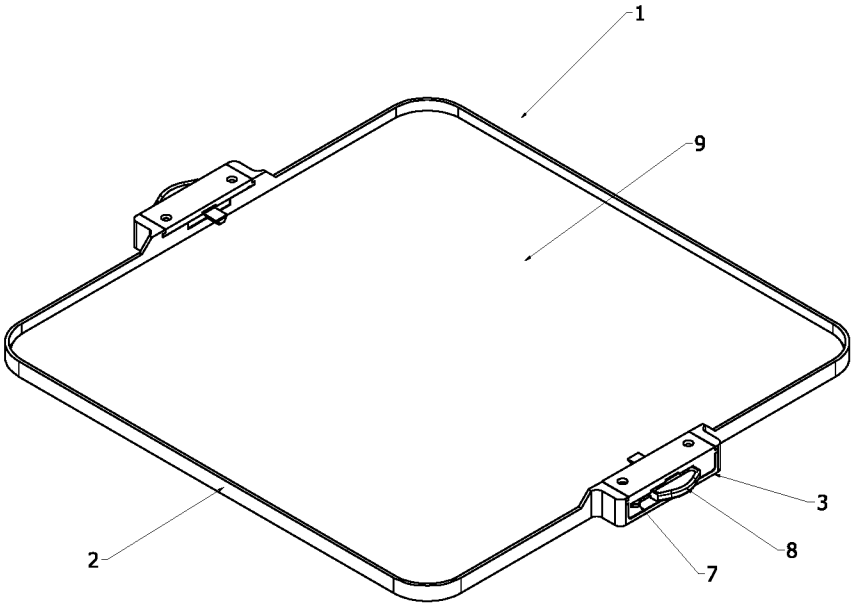
FIG. 2 shows an assembled flip tray in accordance with an embodiment of the present disclosure.

In an embodiment, FIG. 1 shows an optional cover 9 for the base 2. The top surface of the base 2 can be provided with the cover 9, which can be made from silicone or other elastic or flexible material or from the same material as the base. The cover 9 is shown in FIG. 2 on the top planar surface 15 of the base 2. The cover 9 can be a separate component, integral with, or adhesively attached to the base 2, or the like. The cover 9 provides a resilient surface for placing the glassware once they are transferred from the glassware-holding rack to the flip tray. The color is preferably black. In an embodiment, the base can be used without any cover or special top surface material.

Figure 3:
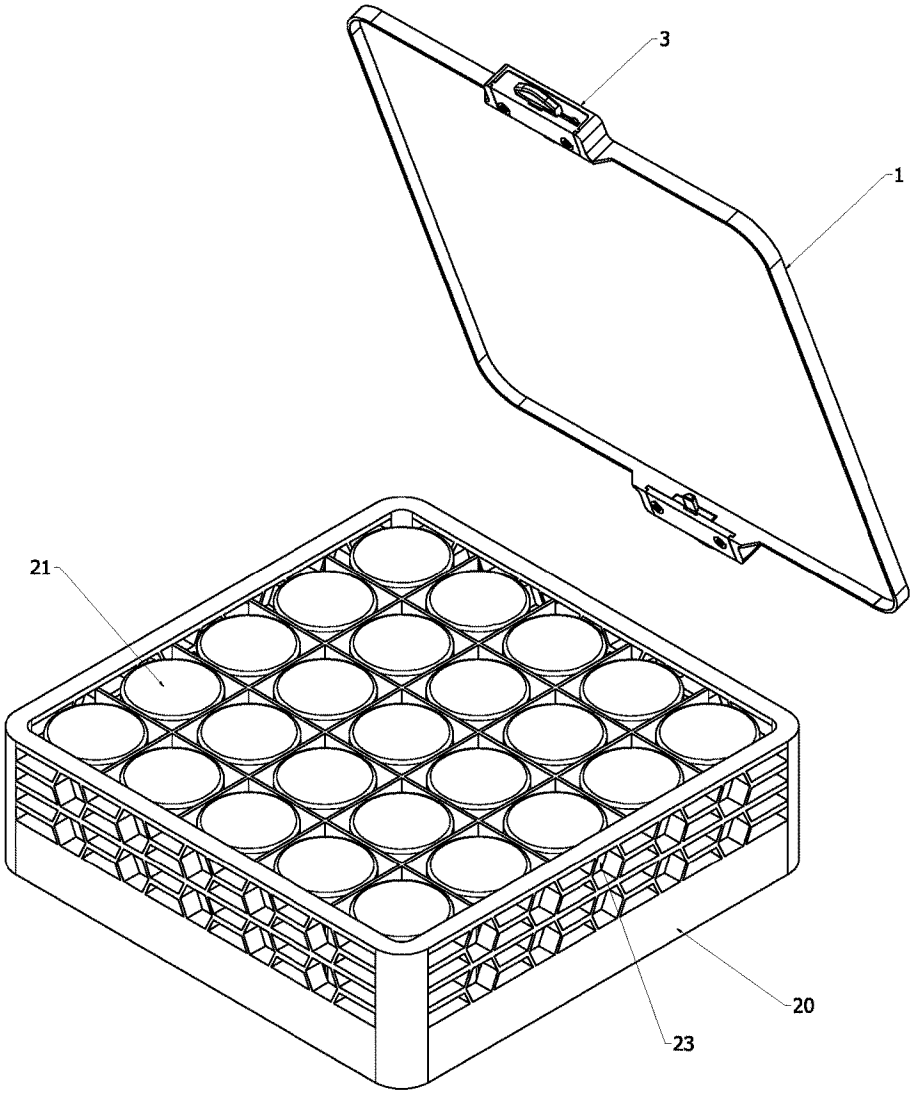
FIG. 3 shows a flip tray being placed upside down on the open top of a glassware-holding rack containing glassware in accordance with an embodiment of the present disclosure.
Figure 4:
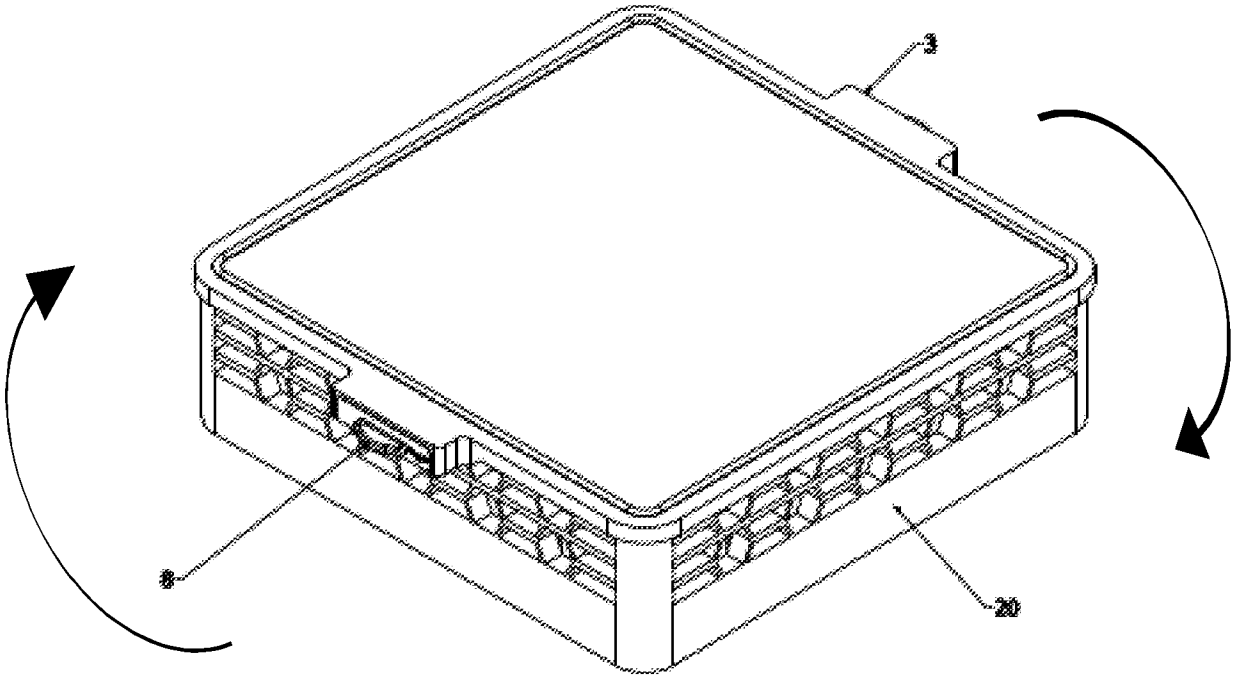
FIG. 4 shows the flip tray secured to the glassware-holding rack and ready for rotation upside down.
Figure 5:
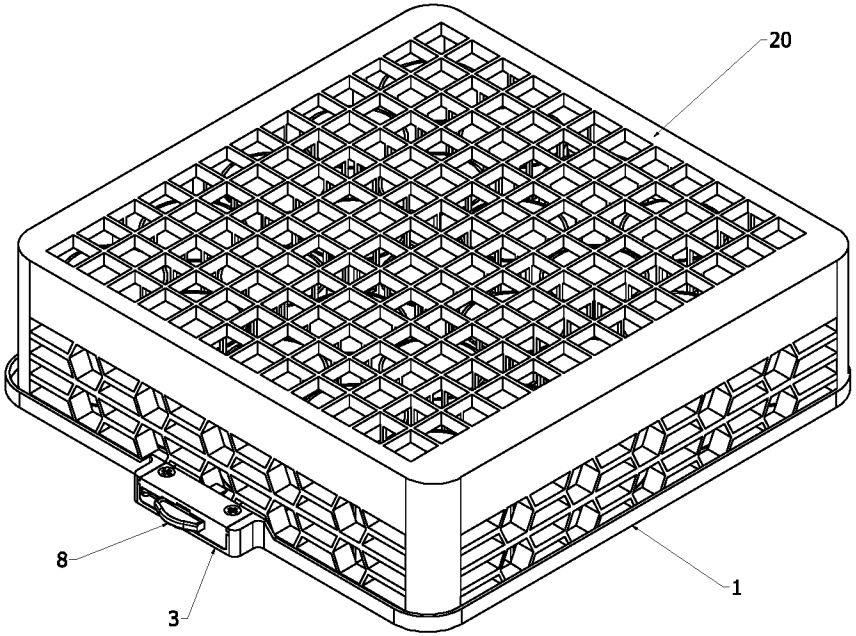
FIG. 5 shows the flip tray secured to the glassware-holding rack shown in FIG. 4 and the entire assembly rotated upside down.
Figure 6:
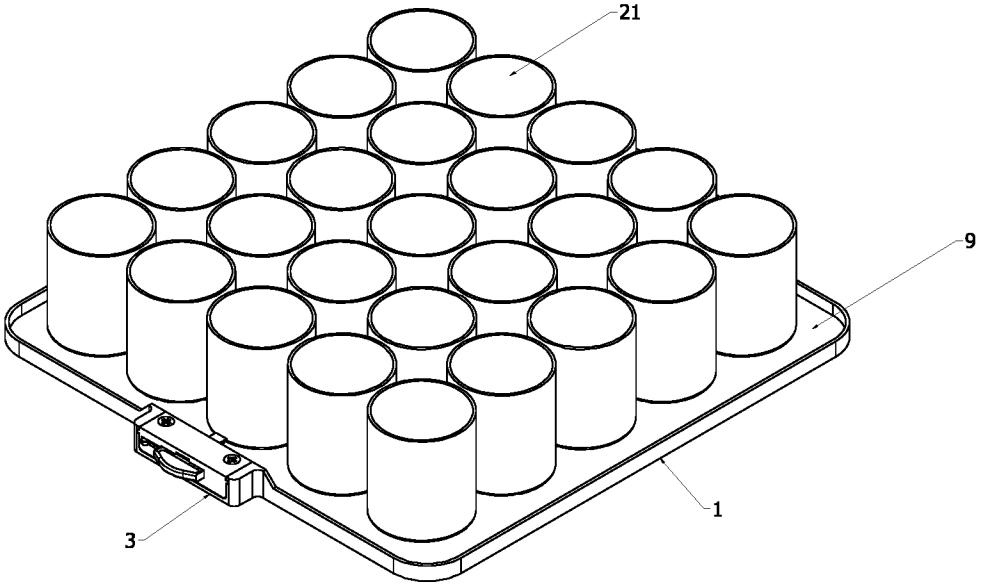
FIG. 6 shows the flip tray shown in FIG. 5 facing up containing the glassware facing up having the glassware-holding rack unlocked from the flip tray and taken off.

FIG. 2 shows an assembled flip tray 1 with handles 3 and cover 9 on the top surface of the base. In accordance with an embodiment, the flip tray 1 is placed facing down on top of a glassware-holding rack 20 containing glassware 21 facing down, as shown in FIG. 3. Then a locking key 8 on each handle 3 of the flip tray 1 is pushed in so the locking key ends penetrate the holes 23 in the middle of the glassware-holding rack 20 on each side, as shown in FIG. 4. Other numbers and manners of locking keys can be used for detachably securing the flip tray to the glassware-holding rack. After the flip tray is locked on the top of the glassware-holding rack, optionally, metal locks, e.g., nickel or any other metal, can be pushed in to touch magnets in the locking mechanism to further secure the flip tray to the glassware-holding rack. Once the locking steps are complete and the flip tray is securely attached to the glassware-holding rack, the flip tray 1 and attached glassware-holding rack 20 can be rotated upside down so that the flip tray 1 is facing up and the glassware-holding rack 20 is facing down, as shown in FIG. 5. That rotating action forces the glassware 21 in the glassware-holding rack 20 to move facing up onto the cover 9 of the flip tray 1, as shown in FIG. 6. The flip tray now can be unlocked and the glassware-holding rack can be taken off and separated from the flip tray to access the glassware ready for use or transport.

Figure 7A:
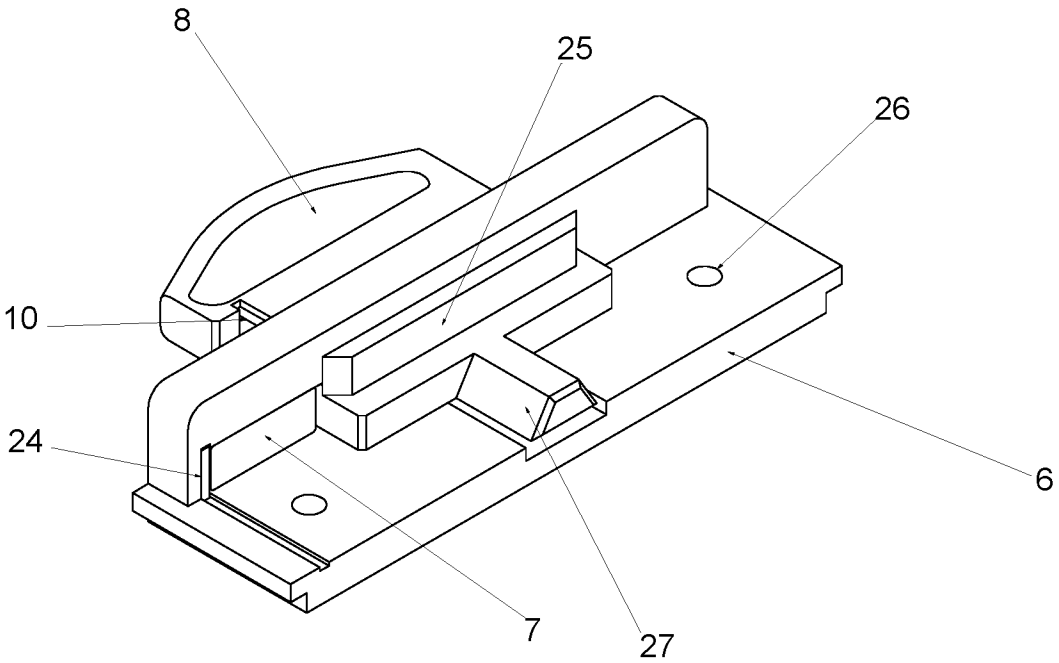
FIG. 7A shows an embodiment of a locking mechanism in an unlocked position.
Figure 7B:
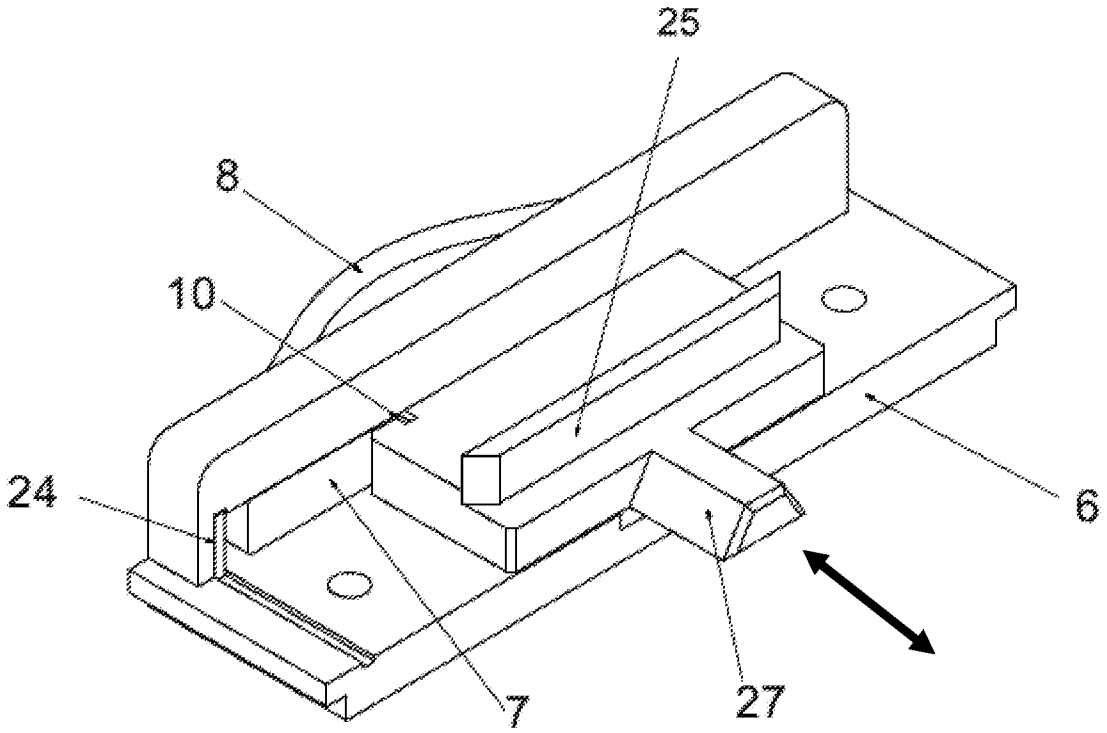
FIG. 7B shows an embodiment of the locking mechanism in a locked position.
Figure 7C:
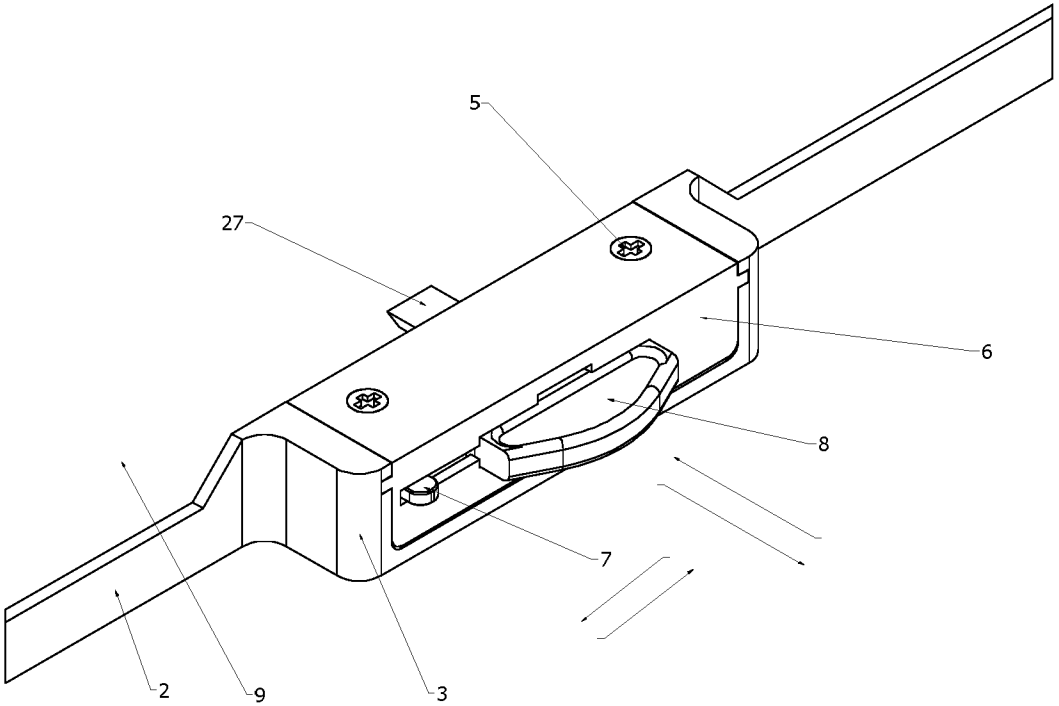
FIG. 7C shows an embodiment of a locking mechanism assembled in a handle of the flip tray.

FIG. 7A shows an embodiment of a locking mechanism in an unlocked position and FIG. 7B shows an embodiment of the locking mechanism in a locked position. The bracket 6 abuts the locking tab 7 which can be magnetic and touches magnet 24 of the bracket 6 or inserted into slot 10 of the key to prevent the key from moving when in a locked position. The slot 10 is part of the key 8. A wall 25 of the key 8 prevents the key 8 from detaching from the locking mechanism. The key touches the bracket wall before locking the key tip 27 into hole 23 of the glassware-holding rack. The bracket 6 has holes 26 where screws 5 are placed keeping the locking mechanism in place attached to the base 3. The tip 27 of the key 8 will penetrate the hole 23 of the glassware-holding rack and will hold securely when the flip tray and rack are rotated. FIG. 7C shows an embodiment of a locking mechanism assembled in a handle, wherein locking key 8 slides back and forth and the locking tab 7 slides side to side in the locking mechanism.

In the embodiment shown in FIGS. 7A-7C, the locking key slideably moves in and out as part of the handle for the flip tray and functions to penetrate a hole of the glassware-holding rack when pushed inside the handle. Once the locking key is securely in the locked position, the locking key slides side to side and functions to hold the weight of the glassware-holding rack containing glassware when rotated 180 degrees. The thickness of the key and material give it a secure and strong advantage. In an embodiment, a feature of the flip tray includes magnetic locks affixed to either side of the product. These magnetic locks are used when the flip tray is placed over the top of the dean glass rack. Once the locks are secured the user can flip the glassware-holding rack allowing for the safe transfer of the glassware from the glassware-holding rack to the flip tray. Once the locks are released and the glassware-holding rack is removed transporting the glassware is as easy as carrying a tray.

An embodiment of a method for presenting an array of glassware in an upright position includes placing a planar top surface of a flip tray face down on an open top of a glassware-holding rack containing a plurality glassware facing down. Detachably securing the flip tray to the glassware-holding rack. Rotating the flip tray glassware-holding rack assembly upside down so that the flip tray is on the bottom facing up and the glassware-holding rack is on the top facing down, allowing the glassware to move facing up onto the flip tray top surface. Detaching the glassware-holding rack from the flip tray. Exposing the plurality of glassware resting upright on the top surface of the flip tray.

Although various embodiments have been depicted and described in detail herein, it will be apparent to those skilled in the relevant art that various modifications, additions, substitutions, and the like can be made without departing from the spirit of the disclosure and these are therefore considered to be within the scope of the disclosure as defined in the claims which follow.

What is claimed is:

1. A flip tray configured to detachably secure to a glassware-holding rack having a lattice configured bottom, lattice configured four side walls, open top and plurality of individual glassware internal compartments, the flip tray comprising:

a rigid planar base having a top surface;

a handle on opposite sides of the base; and a locking mechanism disposed in each handle on opposite sides of the base, wherein the locking mechanism comprises a bracket which holds a slidable locking key in place within the locking mechanism, the locking key is moveable between a locked position in which an end of the locking key passes through a hole in a lattice opening of the side wall of the glassware-holding rack by sliding the locking key towards an interior of the glassware-holding rack securing the locking key to the glassware-holding rack and an unlocked position in which the end of the locking key is withdrawn from the hole in the lattice opening of the side wall of the glassware-holding rack by sliding the locking key away from the interior of glassware-holding rack detachably securing the flip tray to a glassware-holding rack.

2. The device of claim 1, wherein the top surface of the base comprises a flexible cover.

3. The device of claim 1, wherein the locking mechanism-further comprises a locking tab held in place by the bracket and the locking key further comprises a slot, wherein the locking key is secured in the locked position by sliding the locking tab into the slot and the locking key is unsecured in the locked position by sliding the locking tab out of the slot.

4. The device of claim 3, wherein the locking tab is magnetic and the locking mechanism further comprises a magnet in contact with the magnetic locking tab when the locking tab is out of the slot.

5. The device of claim 1, wherein the base comprises polybutylene terephthalate or acrylonitrile butadiene styrene.

6. A method for presenting an array of glassware in an upright position on a tray without any dividers between the glassware, comprising:

placing a planar top surface of a flip tray face down on an open top of a glassware-holding rack having a lattice configured bottom, lattice configured four side walls, open top and plurality of individual glassware internal compartments containing a plurality of down-facing glassware;

locking a locking mechanism disposed on a handle on each of two opposite ends of a base of the flip tray, wherein the locking mechanism comprises a bracket which holds a slidable locking key in place within the locking mechanism, by sliding the locking key in towards an interior of the glassware-holding rack so an end of the locking key passes through a hole in a lattice opening of the side wall of the glassware-holding rack securing the locking key in a locked position thereby detachably securing the flip tray to each of two opposite side walls of the glassware-holding rack;

rotating the flip tray-secured glassware-holding rack upside down so the flip tray is on the bottom facing up and the glassware-holding rack is on the top facing down, allowing the glassware to move facing up onto the flip tray top surface;

unlocking the locking mechanism by sliding the locking key away from the interior of the glassware-holding rack so the end of the locking key is withdrawn from the hole in the lattice opening of the side wall of the glassware-holding rack on the opposite side walls of the glassware-holding rack; and detaching the glassware-holding rack from the flip tray exposing the plurality of glassware resting facing up on the top surface of the flip tray.

7. The method of claim 6, further comprising securing the locking key in the locked position by sliding a locking tab configured to slide into a slot in the locking key and unsecuring the locking key in the locked position by sliding the locking tab out of the slot.

* * * * *